US009745798B2

(12) United States Patent
Preising, Jr. et al.

(10) Patent No.: US 9,745,798 B2
(45) Date of Patent: Aug. 29, 2017

(54) MOVABLE BARRIER SEAL ASSEMBLY

(75) Inventors: Danny L. Preising, Jr., Massillon, OH (US); Charles A. Haba, Massillon, OH (US)

(73) Assignee: Overhead Door Corporation, Lewisville, TX (US)

( * ) Notice: Subject to any disclaimer, the term of this patent is extended or adjusted under 35 U.S.C. 154(b) by 0 days.

(21) Appl. No.: 13/150,937

(22) Filed: Jun. 1, 2011

(65) Prior Publication Data

US 2012/0304543 A1 Dec. 6, 2012

(51) Int. Cl.
*E06B 9/58* (2006.01)
*E06B 7/23* (2006.01)

(52) U.S. Cl.
CPC ..... *E06B 9/582* (2013.01); *E06B 7/2314* (2013.01); *E06B 2009/588* (2013.01)

(58) Field of Classification Search
USPC ... 49/475.1, 484.1, 495.1, 496.1, 498.1, 197
See application file for complete search history.

(56) References Cited

U.S. PATENT DOCUMENTS 2,734,238 A * 2/1956 Clapp ..... 49/493.1
3,106,422 A * 10/1963 White ..... 296/93
3,378,958 A * 4/1968 Parks et al. ..... 49/489.1
3,448,543 A * 6/1969 Multer ..... 49/470
3,656,260 A * 4/1972 Weaver et al. ..... 49/489.1
3,690,037 A * 9/1972 Kempel ..... 49/380
4,006,562 A * 2/1977 Belanger et al. ..... 49/380
4,034,511 A * 7/1977 Bursk ..... 49/489.1
4,447,988 A 5/1984 Cole et al.
4,490,942 A * 1/1985 Arnheim et al. ..... 49/374
4,496,186 A * 1/1985 Tuchiya et al. ..... 296/146.9
4,538,380 A 9/1985 Colliander
4,549,761 A * 10/1985 Lee et al. ..... 296/206
4,635,400 A 1/1987 Mullet
4,745,016 A * 5/1988 Hashimoto et al. ..... 428/122
4,945,681 A * 8/1990 Nozaki et al. ..... 49/495.1
5,010,943 A * 4/1991 Boyer ..... 160/351
5,174,065 A * 12/1992 Schlicht ..... 49/489.1
5,367,830 A * 11/1994 Omura et al. ..... 49/475.1
5,388,371 A * 2/1995 Nozaki ..... 49/377
5,435,104 A 7/1995 Dietrich
5,486,026 A * 1/1996 Borgardt ..... 292/71
5,488,805 A 2/1996 Mass
5,499,475 A * 3/1996 Court et al. ..... 49/495.1
5,553,913 A * 9/1996 Nabuurs ..... 296/216.09
5,784,834 A * 7/1998 Stutzman ..... 49/475.1
6,167,657 B1 * 1/2001 Burge et al. ..... 49/496.1
6,227,607 B1 * 5/2001 Dewald et al. ..... 296/165
6,360,489 B1 * 3/2002 Burge et al. ..... 49/496.1
6,374,545 B1 * 4/2002 Baczuk ..... 49/470
6,374,567 B1 4/2002 Mullet (Continued)

*Primary Examiner* — Katherine Mitchell
*Assistant Examiner* — Shiref Mekhaeil
(74) *Attorney, Agent, or Firm* — Gardere Wynne Sewell LLP

(57) ABSTRACT

A seal assembly for an upward acting door that is positionable between an open and closed position. The seal assembly contains a base member having a first and second flexible sealing member extending therefrom for sealing engagement with the door. The base member is mounted adjacent the door to facilitate sliding engagement between the door and the first and second seal members as the door is moved between the open and closed positions.

10 Claims, 2 Drawing Sheets

(56) References Cited

U.S. PATENT DOCUMENTS

| | | | | |
|---|---|---|---|---|
| 6,393,766 | B2 | 5/2002 | Nozaki et al. | |
| 6,772,560 | B2 * | 8/2004 | Dischiant et al. | 49/496.1 |
| 6,772,561 | B1 * | 8/2004 | Berger, Jr. | 49/496.1 |
| 6,811,213 | B2 * | 11/2004 | Yamashita et al. | 296/216.06 |
| 6,966,590 | B1 * | 11/2005 | Ksiezopolki et al. | 296/26.01 |
| 7,036,548 | B2 | 5/2006 | Johnston et al. | |
| 7,197,850 | B2 * | 4/2007 | Mizutani et al. | 49/498.1 |
| 7,363,749 | B2 * | 4/2008 | Sultan et al. | 49/490.1 |
| 7,380,854 | B1 * | 6/2008 | Hanser et al. | 296/26.13 |
| 7,380,862 | B2 * | 6/2008 | Olney et al. | 296/107.04 |
| 7,578,098 | B2 * | 8/2009 | Furuzawa et al. | 49/498.1 |
| 7,614,676 | B2 * | 11/2009 | Ksiezopolski et al. | 296/26.09 |
| 7,614,677 | B2 * | 11/2009 | Ksiezopolski et al. | 296/26.09 |
| 7,658,441 | B2 * | 2/2010 | Rich et al. | 296/216.09 |
| 7,743,814 | B2 * | 6/2010 | Woodward et al. | 160/40 |
| 8,104,227 | B2 * | 1/2012 | Tamura | 49/377 |
| 8,146,985 | B2 * | 4/2012 | Nelson | 296/146.8 |
| 2001/0025454 | A1 * | 10/2001 | Cretin | 49/441 |
| 2002/0078634 | A1 * | 6/2002 | McManus et al. | 52/67 |
| 2002/0089213 | A1 * | 7/2002 | Gehman et al. | 296/171 |
| 2005/0000165 | A1 * | 1/2005 | Dischinat et al. | 49/496.1 |
| 2006/0162258 | A1 * | 7/2006 | Yamashita et al. | 49/495.1 |
| 2007/0227072 | A1 * | 10/2007 | Kawase et al. | 49/377 |
| 2010/0242373 | A1 * | 9/2010 | Iacovoni et al. | 49/495.1 |
| 2012/0079771 | A1 * | 4/2012 | Meulemans | 49/484.1 |

* cited by examiner

MOVABLE BARRIER SEAL ASSEMBLY

BACKGROUND

A typical garage door installation requires a gap between the garage door and the frame on a building to ensure unrestricted movement of the door when moving between the closed position and the open position. Unfortunately, such gaps can result in the infiltration of water, air, light and debris inside the garage along with thermal inefficiencies. In addition, such gaps result in unwanted lateral movement of the door, thus not only resulting in irritating noise, but creating rattling and movement that can potentially damage the door or building frame.

Various solutions have been tried to overcome these deficiencies. For example, door stops have been utilized to restrain the door from outward or lateral movement of the door when in the closed position. In addition, a weather seal is oftentimes used particularly in cold climates to seal the gap between the door frame and the perimeter of the door when the door is in the closed position. These weather seals resist airflow around the door and also prevent dirt and debris from entering the garage. However, there is a need to provide an improved seal design to reduce the infiltration of water, air, light and debris inside the garage along with the ability to minimize thermal inefficiencies and any unwanted and potentially damaging lateral movement of the door.

SUMMARY

In accordance with the principles of the present invention, a seal assembly is provided for enclosing the gap formed between the door frame and the door that is vertically positionable between the door's open and closed position. The seal assembly includes a base member preferably coupleable to the door frame or other supporting structure adjacent the door and contains a first sealing member or wiper angularly extending from the base member and a second sealing member or bulb extending from the base member. The base member is mounted adjacent the door such that the wiper and bulb prevent light, water, debris and air infiltration into a garage. In addition, the bulb functions to resist lateral movement of the door when in the closed position or when transitioning between the open and closed positions. The wiper and bulb are preferably formed of a deflectable material such that as the door is moved between the open and closed positions, the movable barrier slideably engages the first and second sealing members.

DETAILED DESCRIPTION

Figure 1:
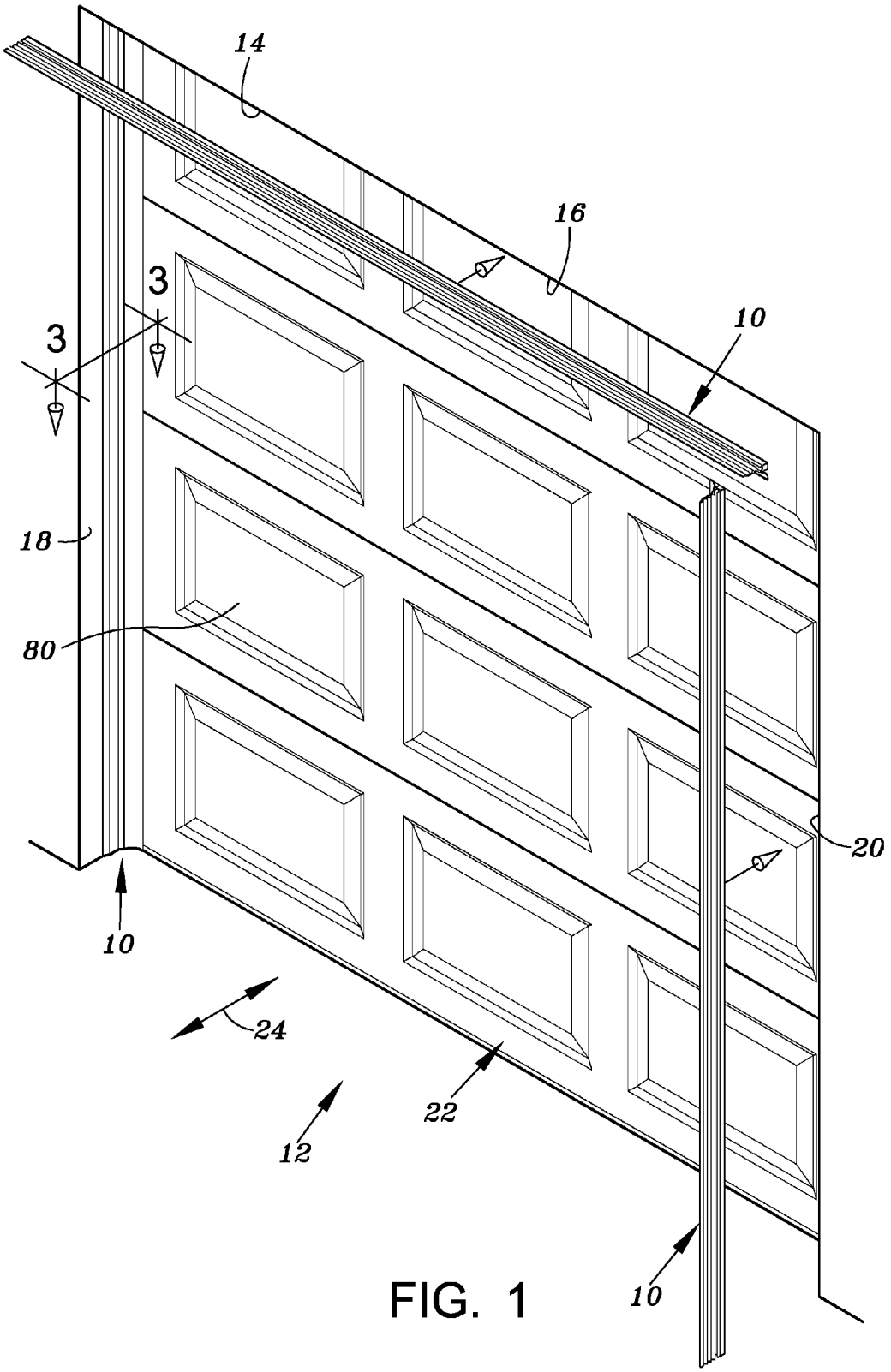
FIG. 1 is an illustration of an upward acting door in which the seal assembly is employed to advantage of the present invention.

In the description which follows, like parts are marked throughout the specification and drawings with the same reference numerals, respectively. The drawings are not necessarily to scale and certain features may be shown exaggerated in scale or in somewhat schematic form in the interest of clarity and conciseness.

Referring initially to FIG. 1, a the seal assembly 10 employed that performs the dual function of providing a barrier seal and a barrier stop for an upward acting door 22, such as, for example, an upward acting sectional garage door. Specifically, seal assembly 10 is used for a garage 12 having an opening 14 formed by a top frame member 16 and side frame members 18 and 20. Preferably, seal assembly 10 is disposed overlying frame member 16 and side frame members 18 and 20 and is configured to form a seal between the door 22 and opening 14 formed by frame members 16, 18 and 20. In particular, seal assembly 10 functions to seal off, or otherwise prevent light, water, debris and/or air infiltration into, garage 12. In addition, the assembly functions as a stop so as to resist lateral movement of door 22 in the direction of arrows 24, which occurs because of pressure differences between the interior and exterior of the garage.

Figure 2:
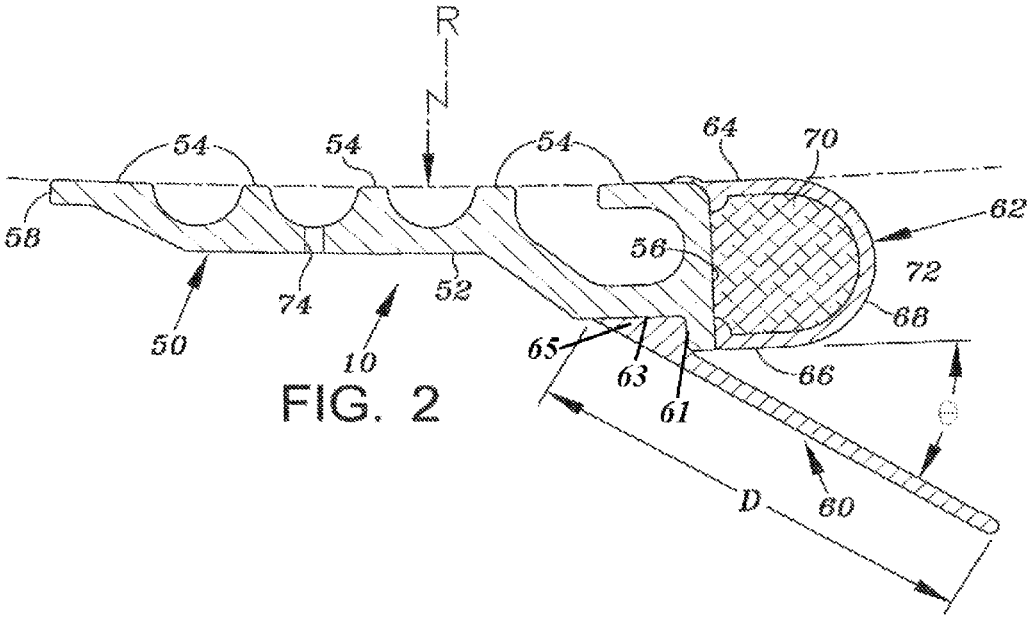
FIG. 2 is a plan view of the seal assembly of FIG. 1.

Referring now to FIG. 2, seal assembly 10 particularly comprises a base member 50 having a front surface 52, a rear surface 54, a top surface 56 and a bottom surface 58 for supporting a wiper or first seal member 60 and a bulb or second seal member 62. Wiper 60 angularly extends from base member 50 and is preferably formed of a flexible polymeric sheet, such as, for example, polyvinylchloride. However, it should be understood that wiper 60 may be formed of any flexible material. Preferably, wiper 60 extends for a short distance D, e.g., approximately 1.6 inches from and is mounted at an angle θ from the surface of door 22 of approximately 33 degrees; however, it should be understood that other values of D and θ can be used. The wiper 60 includes a base section 65 secured to the base member 50 at two different surfaces 61 and 63. The surfaces 61 and 63 are angularly disposed and form angles other than θ from the surface of door 22. For example, the surfaces 61 and 63 are perpendicular to each other and the surface 61 is parallel to the to surface 56. In FIG. 1, bulb 62 extends from top surface 56 and is also formed of a flexible polymeric material, such as, for example, polyvinylchloride; however, it should be understood that bulb 62 may be otherwise formed of a material that is capable of deforming and/or otherwise flexing in order to sealingly seat against door 22. In the embodiment illustrated in FIG. 2, bulb 62 is formed of a continuous sheet material folded to form first and second legs 64 and 66 connected via an arcuate portion 68, which form an interior area 70. Optionally, interior area 70 may include an insulative material 72 disposed within interior area 70 to improve thermal resistance, as described in greater detail below.

Preferably, rear surface 54 is arcuately formed having a radius "R" to prevent or otherwise resist outward bowing or flexing of base member 50 as it is coupled to frames 16, 18 and/or 20. For example, in the embodiment illustrated in FIG. 2, base member 50 contains a pilot hole 74 to receive a fastener 76 (e.g., a nail or screw) for coupling to frame 16, 18 and/or 20. As fastener 76 secures base member 50 to frame 16, 18 and/or 20, the mid section of base member 50 is positioned toward and adjacent to the frame so as to preferably rest flush therewith to increase the sealing engagement with the frame and reducing the likelihood of the ends of the base member 50 (i.e., the portions of base member 50 near surface 56 and 58) lifting or otherwise separating from the frame.

Figure 3:
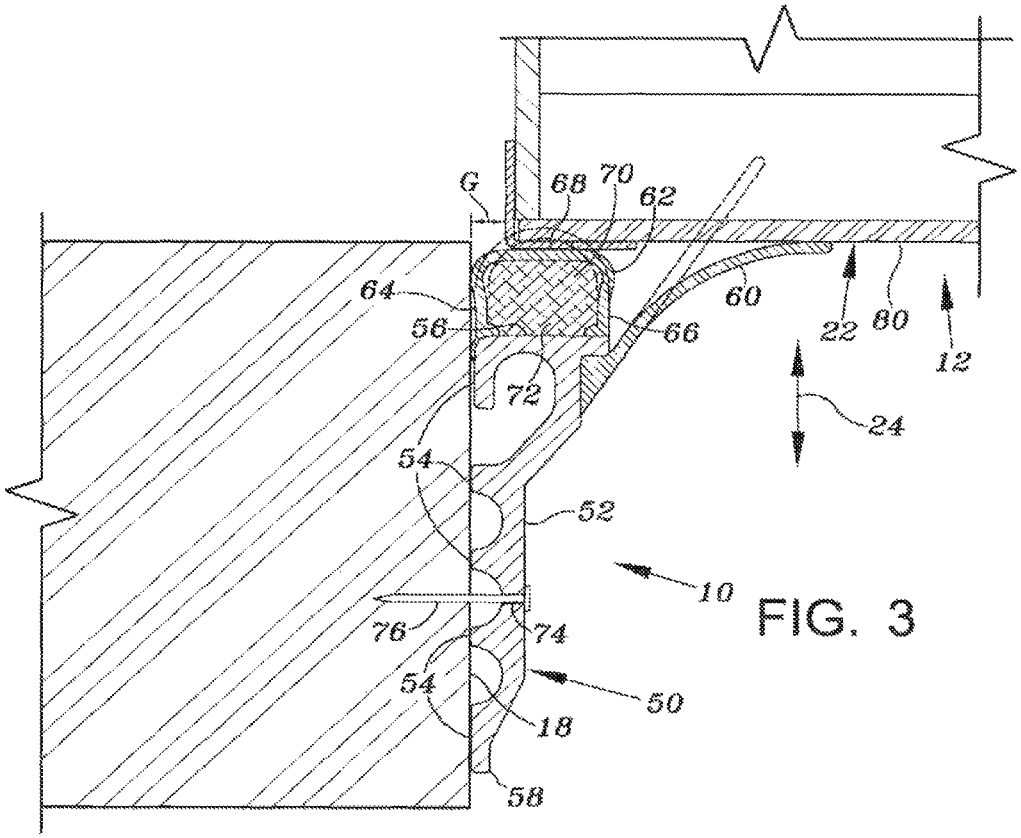
FIG. 3 is a section view of the seal assembly depicted in FIGS. 1 and 2 taken along the section line 3-3 of FIG. 1.

Referring now to FIG. 3, it can be seen that the seal assembly 10 is positioned on frame member 18 to seal or otherwise enclose a gap G that is formed between frame member 18 and door 22. In particular, seal assembly 10 is coupled to frame member 18 such that wiper 60 and bulb 62 are deformed to be in sliding contact with an outer surface of face 80 of door 22 to enclose gap G, to thereby prevent light, water, debris and air from penetrating therethrough. In operation, bulb 62 is of a sufficient resiliency to function, not only as a seal, but as a door stop to prevent or substantially resist lateral movement of the door in the direction of arrows 24 (FIG. 3). Preferably, wiper 60 and bulb 62 are of a significant hardness durometer, preferably between 75 and 83. However, it should be understood that wiper 60 and bulb 62 may be otherwise formed to have a larger or smaller durometer.

The seal assembly 10 is preferably manufactured by co-extrusion so as to form a single unitary system consisting of rigid base member 50, flexible wiper 60 and flexible bulb 62. As illustrated in FIG. 2, wiper 60 and bulb 62 are in a non-deformed shape, such as when door 22 is in an open position. As illustrated in FIG. 3, wiper 60 and bulb 62 are deformed and positioned in sliding engagement with door 22.

Although embodiments of seal assembly 10 have been described in detail, those skilled in the art will also recognize that various substitutions and modifications may be made without departing from the scope and spirit of the invention, as defined solely by the appended claims.

What is claimed is:

1. A seal assembly for an upward acting garage door enclosing an opening formed by a top frame member and a pair of side frame members, the upward acting garage door positionable between a fully open position and a fully closed position, the seal assembly comprising:

a base member having a front surface, a rear surface, a top surface and a bottom surface, said rear surface to mate against and to be secured to one of the side frame members, the front and rear surfaces are opposed to each other and wherein the front and rear surfaces extend perpendicular to the upward acting garage door when the rear surface of the base member is mated against and secured to one of the side frame members;

a first sealing member secured to the base member at the front surface and including a base section and a wiper angularly extending from the base section, wherein the wiper is configured to engage with the upward acting garage door to flexibly press against the upward acting garage door;

a second sealing member comprising a bulb seal, said second sealing member is secured to the base member and extends from the base member at the top surface to face the upward acting garage door, the top surface being generally perpendicular to the front surface;

wherein the wiper of the first sealing member protrudes beyond the second sealing member when not flexibly pressing against the upward acting garage door;

each of the first sealing member and the second sealing member are configured to slidingly and sealingly engage the upward acting garage door when the upward acting garage door is moving between the fully open position and the fully closed position, wherein the second sealing member generates a friction force with the upward acting garage door in a direction parallel to a longitudinal axis of said second sealing member, and said first and second sealing members generate said friction force in said direction perpendicular to a longitudinal axis of said base member when the upward acting garage door is moving between the fully open and fully closed positions;

wherein the wiper of the first sealing member and the bulb seal of the second sealing member have top surfaces that protrude a substantially same amount beyond the top surface of the base member when said bulb seal and said wiper simultaneously slideably engage a face of the upward acting garage door to resist lateral movement of the door.

2. The seal assembly of claim 1, wherein the first sealing member and base member are co-extruded into a single component.

3. The seal assembly of claim 1, wherein the base member and first and second sealing members are co-extruded into a single component.

4. The seal assembly of claim 1, wherein the base member is formed of a polymer.

5. The seal assembly of claim 1, wherein the first and second sealing members are formed of a polymer.

6. The seal assembly of claim 1, wherein the first sealing member seal is a wiper that flexes outwardly away from base member when the garage door is in the closed position.

7. The seal assembly of claim 1, wherein the second sealing member comprises a sufficient resiliency to deform while remaining in sliding engagement with the garage door, thereby reducing noise generated by the garage door by maintaining pressure against the upward acting garage door when the upward acting garage door is in the closed position.

8. The seal assembly of claim 1, wherein the base member has a surface that is arcuate.

9. A seal assembly for enclosing a gap formed between an upward acting garage door and a building frame having a pair of side frame members, the upward acting garage door being movable between a fully open position and a fully closed position, the seal assembly comprising:

a base member having a front surface, a rear surface, a top surface and a bottom surface, the front and rear surfaces are opposed to each other and wherein the front and rear surfaces are perpendicular to the upward acting garage door;

a first sealing member angularly extending from the front surface proximate the top surface and configured to slideably engage the upward acting garage door to enclose the gap, the first sealing member having a base section and a wiper extending from the base section at the front surface;

a second sealing member comprising a bulb seal, said second sealing member extending outwardly from the top surface and being of a sufficient resiliency to deform and slideably engage the upward acting garage door to enclose the gap, the top surface being generally perpendicular to the front surface;

wherein the wiper of the first sealing member protrudes beyond the second sealing member when not slidably engaging the upward acting garage door;

wherein the second sealing member generates a friction force with the upward acting garage door in a direction parallel to a longitudinal axis of said second sealing member, and said first and second sealing members generate said friction force in said direction perpendicular to a longitudinal axis of said base member when the upward acting garage door is moving between the fully open and fully closed positions;

wherein the wiper of the first sealing member and the bulb seal of the second sealing member have top surfaces that protrude a substantially same amount beyond the top surface of the base member when said bulb seal and said wiper simultaneously slideably engage a face of the upward acting garage door to resist lateral movement of the door.

10. The seal assembly of claim 9, wherein the rear surface is arcuate.

* * * * *